US007931013B2

(12) United States Patent
Castaño González et al.

(10) Patent No.: US 7,931,013 B2
(45) Date of Patent: Apr. 26, 2011

(54) THREE-PASS HEAT EXCHANGER FOR AN EGR SYSTEM

(75) Inventors: Carlos Manuel Castaño González, Vigo (ES); José Antonio Grande Fernández, Vigo (ES)

(73) Assignee: Dayco Ensa, S.L., Vigo (ES)

( * ) Notice: Subject to any disclaimer, the term of this patent is extended or adjusted under 35 U.S.C. 154(b) by 75 days.

(21) Appl. No.: 12/085,305

(22) PCT Filed: Nov. 22, 2006

(86) PCT No.: PCT/EP2006/068742

§ 371 (c)(1),
(2), (4) Date: Feb. 13, 2009

(87) PCT Pub. No.: WO2007/060172

PCT Pub. Date: May 31, 2007

(65) Prior Publication Data

US 2009/0260604 A1 Oct. 22, 2009

(30) Foreign Application Priority Data

Nov. 22, 2005 (ES) ..... 200502863

(51) Int. Cl.
*F02B 47/08* (2006.01)
*F02B 47/00* (2006.01)

(52) U.S. Cl. ..... 123/568.12

(58) Field of Classification Search ..... 123/568.12, 123/568.11; 701/108; 60/278, 280, 298, 60/605.1, 605.2; 165/103, 153, 158
See application file for complete search history.

(56) References Cited

U.S. PATENT DOCUMENTS

| | | | | |
|---|---|---|---|---|
| 3,884,297 | A * | 5/1975 | Fegraus et al. | 165/145 |
| 4,450,932 | A * | 5/1984 | Khosropour et al. | 181/211 |
| 4,593,749 | A * | 6/1986 | Schatz | 165/283 |
| 5,732,688 | A * | 3/1998 | Charlton et al. | 123/568.12 |
| 7,699,028 | B2 * | 4/2010 | Guerrero et al. | 123/41.29 |
| 7,743,816 | B2 * | 6/2010 | Mercz et al. | 165/11.1 |
| 2007/0051359 | A1 * | 3/2007 | Missoum et al. | 126/110 R |

FOREIGN PATENT DOCUMENTS

| | | |
|---|---|---|
| EP | 0844453 | 5/1998 |
| EP | 1367253 | 12/2003 |
| FR | 2852678 | 9/2003 |
| WO | WO 03/062625 | 7/2003 |
| WO | WO 03/098026 | 11/2003 |

OTHER PUBLICATIONS

European Search Report mailed Jan. 14, 2009 in European Application 08165549.0-2311.

* cited by examiner

*Primary Examiner* — Mahmoud Gimie
(74) *Attorney, Agent, or Firm* — Davidson Berquist Jackson & Gowdey, LLP

(57) ABSTRACT

The present invention relates to a three-pass heat exchanger for an EGR system, comprising a casing housing at least one cooling chamber for gas circulating through a plurality of pipes and heads on its ends coupled to the gas inlet pipe coming from the exhaust manifold and to the gas outlet pipe connected to the intake manifold of the engine, which is configured as a three-pass heat exchanger, i.e. with three differentiated areas for gas circulation from the inlet pipe to the outlet pipe, the inlet pipe and the outlet pipe being located at opposite ends of the exchanger. The exchanger can include a bypass valve and two cooling chambers at different temperatures.

18 Claims, 3 Drawing Sheets

THREE-PASS HEAT EXCHANGER FOR AN EGR SYSTEM

FIELD OF THE INVENTION

The present invention relates to a heat exchanger for an exhaust gas recirculation (EGR) system for an internal combustion engine, and more particularly to a heat exchanger with three differentiated passes of gas circulation within it.

BACKGROUND OF THE INVENTION

Different exhaust gas recirculation systems in internal combustion engines, called EGR systems, are known in the current state of the art.

These systems recirculate exhaust gases from the exhaust manifold to the intake manifold of the engine after subjecting them to a cooling process for the purpose of reducing the amount of NOx emissions.

The cooling process is carried out in heat exchangers formed by cooling chambers housing a group of pipes through which the gas passes that are surrounded by a coolant undergoing permanent recirculation.

Single-pass heat exchangers in which the exhaust gas enters at one end, is distributed among said pipes and exits at the opposite end at a lower temperature after having yielded heat to the coolant, are well known in the art.

These exchangers can include bypass lines allowing the recirculation of exhaust gases without passing through the heat exchanger, under the control of a valve channeling the exhaust gases either towards the heat exchanger or towards the bypass line, according to pre-established conditions.

The capacities of a heat exchanger for an EGR system are defined by 2 parameters:

Efficiency: This is the ratio of the obtained cooling and maximum cooling that could be obtained under working conditions:

$$Ef=(Tig-Tog)/(Tig-Tiw), \text{ where}$$

Ef=efficiency

Tig=inlet gas T

Tog=outlet gas T

Tiw=inlet water or coolant T

Pressure drop. This is the loss of pressure in the gas due to friction, changes of section and other turbulences that the gas experiences while traveling through the part.

In all heat exchangers for an EGR system efficiency tends to be maximized so as to thus reduce the level of NOx produced in the engine and to minimize the pressure drop for the purpose of being able to recirculate the largest amount of exhaust gas.

When designing a heat exchanger for an EGR system, it is also necessary to take into account the available space in the engine, so a given length in each case cannot be exceeded for the purpose of improving the efficiency of the part.

In this sense, two-pass heat exchangers for an EGR system are known which have a rounded head at one of their ends, forcing the gas to re-enter the pipes subjected to cooling, so that the gas carries out two passes through them, hence the name.

In this type of exchangers the gas inlet has the outlet attached, and it further allows incorporating a bypass valve to bypass the heat exchanger during the first few minutes after starting up the engine so as to aid it to quickly reach the operating temperature and to start up the catalyst.

The two-pass heat exchanger is more efficient than the one-pass heat exchanger, although the pressure drop is somewhat greater as well (depending on the number of pipes used) and the outer diameter of the casing is larger. However, a casting piece must be used at the inlet, separating the inlet from the outlet, notably making it more expensive.

However, if the outlet of the exhaust manifold from where the EGR gas is taken is located at one end of the exchanger and the inlet to the intake manifold is at the opposite end (where the gas must be taken to after making it pass through the exchanger), it will be necessary on multiple occasions to add an external pipe so as to carry the cooled gas to the point of destination.

The need to use this external pipe complicates the designs due to the lack of space in most engines, and on many occasions making the use of this type of exchangers unfeasible.

The automotive industry demands improvements in known EGR systems so as to respond to different needs. One of them has been brought about by the growing demands of administrative regulations regarding admissible NOx emission levels. Another need that must be met is that of facilitating the assembly of engines in automobiles by simplifying the design of their components so as to improve the integration capacity.

SUMMARY OF THE INVENTION

The present invention has as an object providing as an integral element of an EGR system a heat exchanger for recirculated exhaust gases of an internal combustion engine comprising, like known exchangers, a casing housing at least one cooling chamber for gas circulating through a plurality of pipes and heads on its ends coupled to the gas inlet duct coming from the exhaust manifold and to the gas outlet duct connected to the intake manifold of the engine, and unlike known exchangers, having the following features:

- it is configured as a three-pass heat exchanger, i.e. with three differentiated areas for gas circulation from the inlet duct to the outlet duct.
- the inlet duct and the outlet duct are located at opposite ends of the exchanger.

The exchanger may include a bypass valve, in which case one of these three differentiated areas for gas circulation performs the function of a bypass line which, as the case may be, can be insulated by means of a double pipe, assuring extremely reduced efficiency when the bypass function is performed.

The exchanger may in turn include a single cooling chamber or two cooling chambers at different temperatures, the first of them housing one of the differentiated gas passage areas and the second one of them housing the other two.

The following must be pointed among the advantages of the three-pass exchanger according to the invention:

- High efficiency.
- A highly compact part.
- Inlet and outlet on opposite ends of the part, therefore external EGR pipes are not required.
- Less fouling, therefore the part has a smaller loss of efficiency.
- It is not necessary to use a casting piece at the inlet, possibly replacing it with foundries, which are much simpler and less expensive.

Other features and advantages of the present invention shall be gathered from the following detailed description of an illustrative and by no means limiting embodiment of its object in relation to the attached drawings.

DETAILED DESCRIPTION OF THE INVENTION

In an EGR system, part of the engine exhaust gases exits outwardly to the exhaust pipe and another part is recirculated. The amount to be recirculated is controlled by the EGR valve which, in certain circumstances, for example in a full throttle situation, can even be closed and not recirculate anything. The recirculated gases mix with clean air and return to the engine through the intake manifold.

Figure 1:
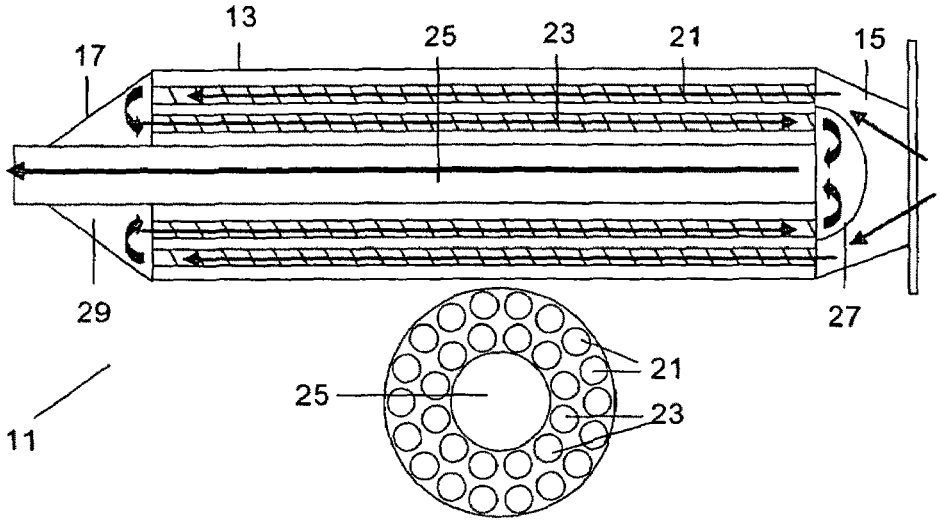
FIG. 1 shows side and cross section views of a heat exchanger for exhaust gases according to a first embodiment of the present invention.

In a first embodiment of the invention, shown in FIG. 1, the exchanger 11 comprises a casing 13, the inside of which houses a cooling chamber with coolant inlet and outlet pipes (not shown), an inlet head 15 and an outlet head 17. The three differentiated gas circulation areas are concentric areas 21, 23, 25, the outer area 21 and intermediate area 23 formed by a plurality of pipes arranged in ring shape. The inner area 25 can be formed by a single pipe, as shown in FIG. 1, with a much lower heat exchange level than the other areas, or by a plurality of pipes like the other two areas, depending on the gas cooling requirements.

It must be observed that the concentric pattern of the cooling areas 21, 23 contributes to less fouling of the exchanger and therefore to an increase in its efficiency since:

The fouling dramatically increases when the gas is colder.

The fouling is reduced if the gas turbulence, i.e. the rate of passage of the gas through the pipes, is increased, therefore if the number of pipes is reduced.

Area 23 has a smaller number of pipes than area 21, and it is where the gas is coldest, so that due to the greater turbulence, the total loss of efficiency of the exchanger due to fouling will be less.

The inlet head 15 includes a semispherical part 27 opposite to the gas inlet, covering said second and third areas 23, 25, preventing the entering gas from accessing them and orienting it towards the outer area 21.

The outlet head 17 has a distribution chamber 29 collecting the gas exiting the pipes of the outer area 21 and guiding it to the pipes of the intermediate area 23 where it continues to be cooled and from where it exits towards the semispherical part 27, which forces the gas to be directed towards the inner pipe 25 since there is no other exit.

The inner pipe 25 extends towards the outlet of the exchanger 11, performing the function of an outlet pipe of the gas traversing the outlet head 17 to which it is attached in a leak-tight manner.

Figure 2A:
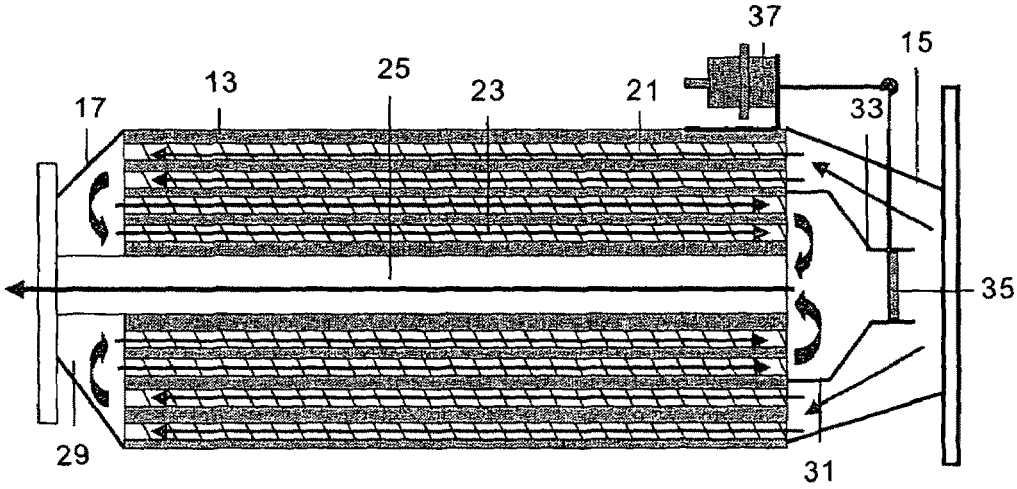
FIGS. 2*a* and 2*b* show side section views of a heat exchanger for exhaust gases according to a second embodiment of the present invention, including a bypass valve, with the gases circulating through the cooled pipes and with the gases passing through the bypass pipe, respectively.
Figure 2B:
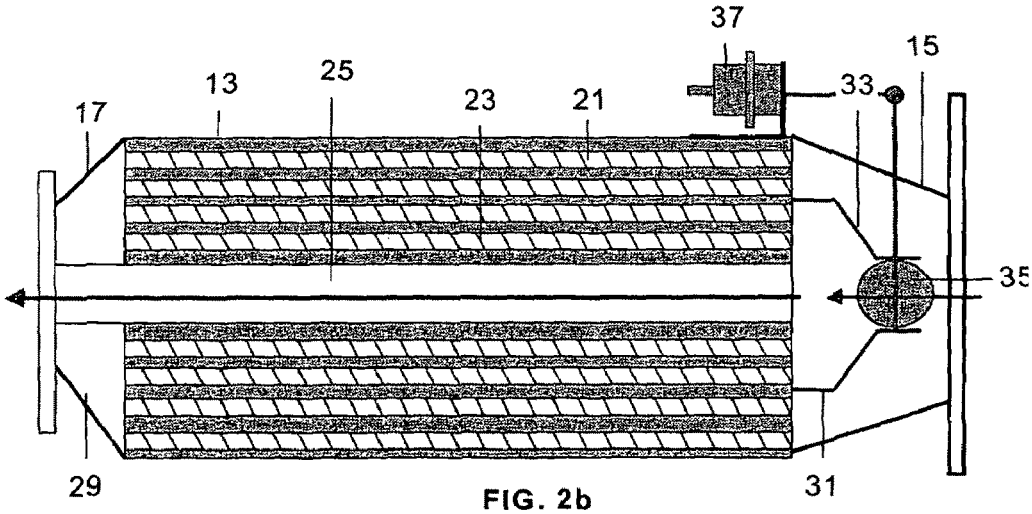

The second embodiment of the invention shown in FIGS. 2*a* and 2*b* is different from the first embodiment in that rather than having a semispherical part 27, the inlet head 15 has an open part 31 with a neck 33 in which a bypass valve is arranged, which is shown as a round blade 35 operated by an external pneumatic actuator 37.

When the actuator 37 is not operating, the blade 35 closes off the neck 33 of the part 31, so the exchanger operates identically as described above (FIG. 2*a*).

When the actuator 37 is actuated, the blade 35 moves 90° and the gas finds the passage space through the neck 33 free, so it is directed directly to the central pipe 25 and exits without cooling. The gas cannot go through areas 21 and 23 since the pressure at the inlet of area 21 is the same as in the outlet of area 23, preventing its circulation.

In this embodiment, if a proportional actuator for the bypass valve is provided, any degree of opening thereof can be obtained, and a heat exchanger can therefore be available in which the flow rate percentage of the EGR gas exiting to the bypass pipe 25 can be controlled and therefore a constant gas outlet temperature can be controlled.

By arranging a temperature sensor measuring the outlet temperature at the outlet of the exchanger, the degree of opening of the bypass valve can be controlled and the desired outlet temperature can be thus obtained. The outlet temperature which could be obtained will be within a range defined by the thermal efficiency of the exchanger and the inlet conditions of the fluids entering the exchanger (EGR gas and coolant).

Figure 3:
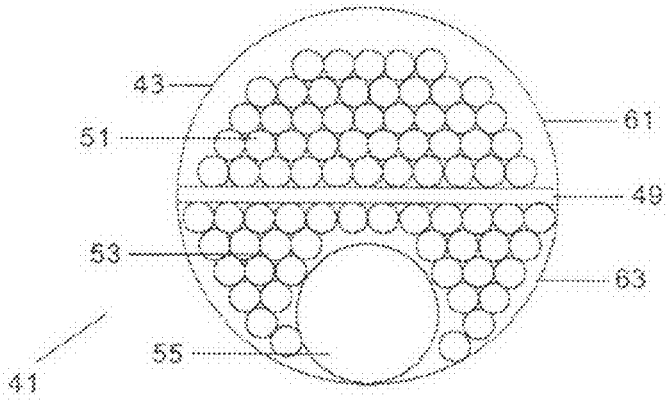
FIG. 3 shows a cross section view of a heat exchanger for exhaust gases according to third, fourth, fifth and sixth embodiments of the present invention.

FIG. 3, which schematically shows a common part of the following embodiments of the invention that will be described, shows an exchanger 41, the casing 43 of which has a circular section and in which one of its halves is occupied by a first gas circulation area 51 and the other half is occupied by the second gas circulation area 53 and third gas circulation area 55, the latter being located on a side close to the casing 43.

Figure 4A:
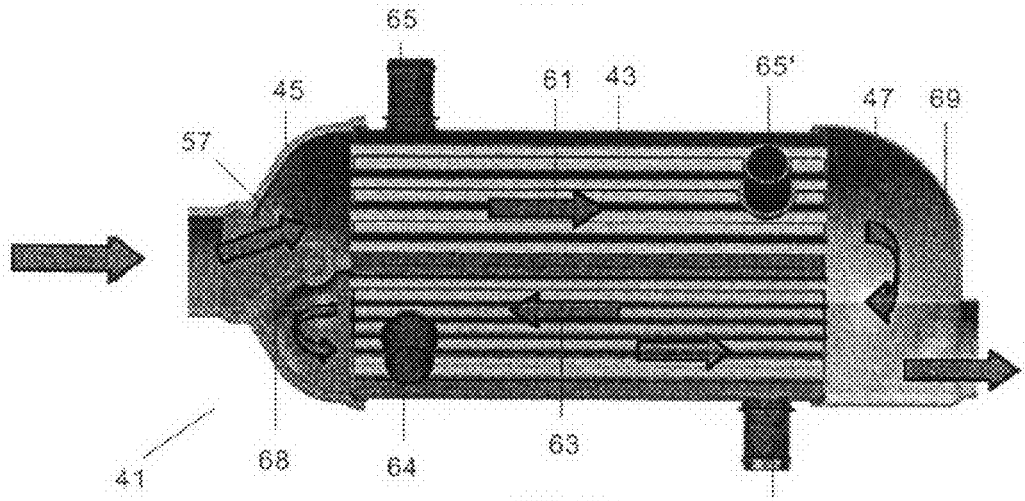
FIGS. 4*a* and 4*b* show side section views of a heat exchanger for exhaust gases according to the third embodiment of the present invention, including a bypass valve, with the gases circulating through the cooled pipes and with the gases passing though the bypass pipe, respectively.
Figure 4B:
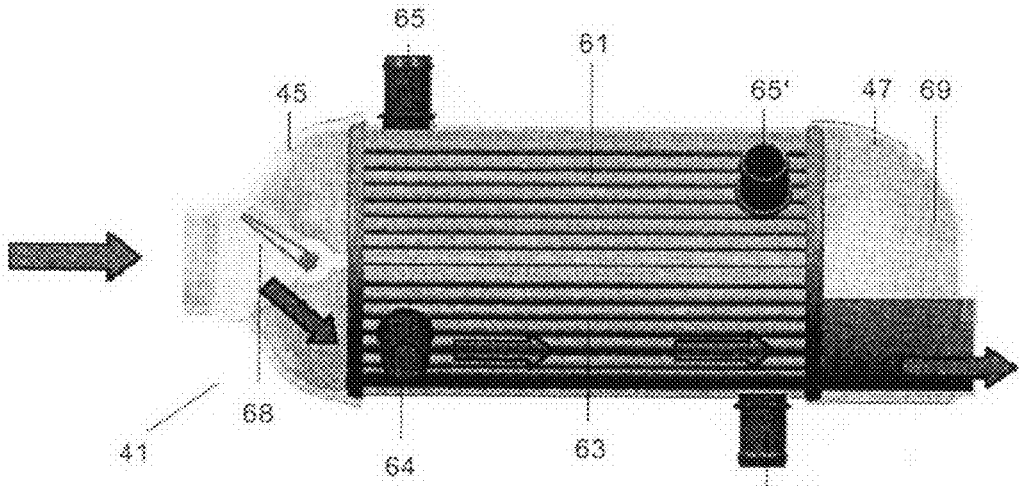

In the third embodiment of the invention shown in FIGS. 4*a* and 4*b*, there are two cooling chambers 61, 63 of a semicircular section that are separated by a central plate 49, with different coolant inlet 65, 64 and outlet 65', 64' pipes, an inlet head 45 and an outlet head 47. The two cooling chambers 61, 63 are separated so as to be able to operate with coolants at different temperatures, for example 110° C. and 60° C.

The cooling chamber at the higher temperature 61 houses the first gas circulation area 51 through a plurality of pipes. The cooling chamber at the lower temperature 63 houses the second gas circulation area 53, formed by a plurality of pipes and the third one is formed by a single pipe 55 with a much lower heat exchange level than the other areas.

The inlet head 45 includes a part 57 incorporating a bypass valve 68 with an actuator 77, of the type disclosed in Spanish patent number 2,223,217, and the outlet head 47 has a distribution chamber 69 collecting the gas exiting area 51 and directing it to the pipes of area 53.

The operation of the exchanger is similar to that of the previous embodiment. With the bypass valve 68 closed, the outlet gas passes successively through the three circulation areas 51, 53 and 55, with the bypass valve open, it passes directly to area 55 which performs the function of a bypass pipe, and with the bypass valve 68 partially open, it is distributed between both circuits.

A fourth embodiment of the invention is similar to the third embodiment without the bypass valve. In this case, the part 57 is configured so as to on one hand close off the access of the inlet gas to the second area 53 and the third area 55, but allowing its passage to the first area 51 and, on the other hand, to facilitate gas circulation from the second area 53 to the third area 55.

A fifth embodiment of the invention is different from the fourth one in that there would be one cooling chamber rather than two.

Figure 5:
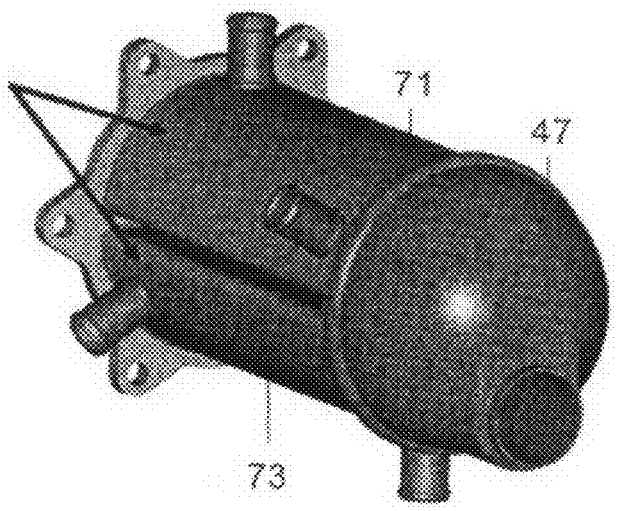
FIG. 5 shows a perspective view of a heat exchanger for exhaust gases according to a sixth embodiment of the present invention.
Figure 6:
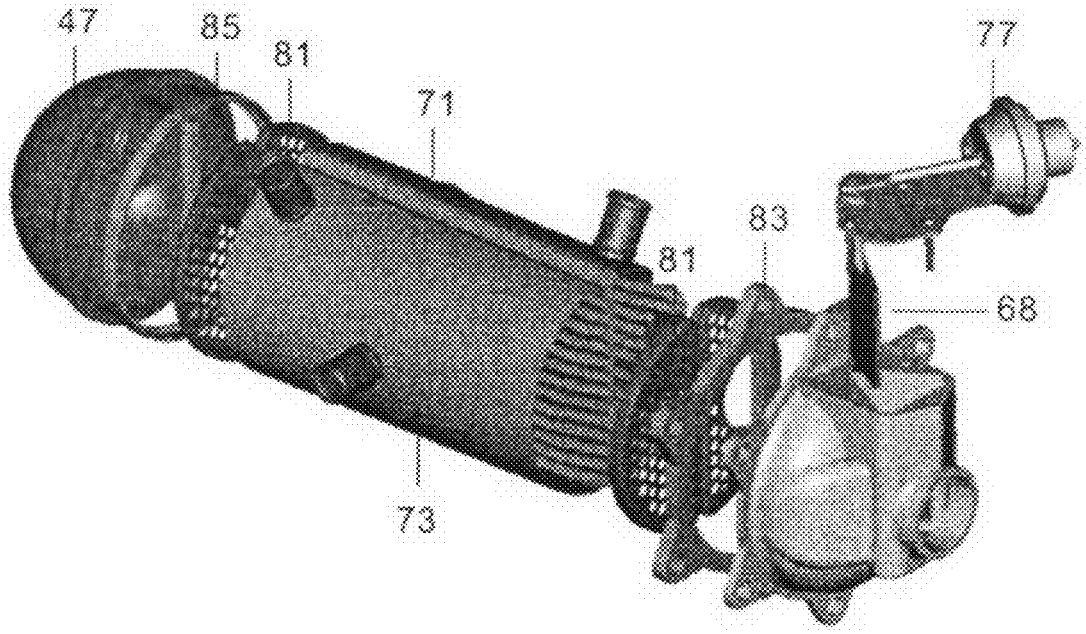
FIG. 6 shows an exploded perspective view thereof.

The sixth embodiment shown in FIGS. 5 and 6 differs from the third one only in that it has two different semi-casings 71, 73 rather than a one casing 13, each one of them housing the cooling chambers 61, 63.

Covers 81, flanges 83 and intermediate plates 83 used in this type of heat exchangers for joining the cooling chamber to the inlet and outlet heads can further be seen in these figures.

In its different embodiments, the exchanger according to the invention provides different possibilities of controlling or adapting the gas flow, particularly the following possibilities.

Using a different number of pipes in each differentiated gas circulation area or passage. This has the advantage that a mean rate that is the same in each one of the passages can be maintained. As it is well known, when exhaust gas is cooled its volume is reduced due to the effect of the temperature, so for a given passage-free section, the rate of the gas will be gradually reduced. Having different numbers of pipes allows having high gas flow rates in the areas where there is a higher risk of particle deposition. Smaller flow rates are allowed in high temperature areas so as to not compromise the pressure drop and without the risk of fouling, and in low temperature areas with a risk of fouling, this is minimized by the increase in the gas flow rate.

Using pipes of different diameters in each differentiated gas circulation area or passage.

Using pipes with different degrees of heat exchange in each gas circulation area or passage. Pipes with different grooving can be used in each passage, or even smooth pipes can be used in any passage in which pressure drops are desired to be minimized, and pipes with grooving in the passage in which the thermal exchange must be maximized.

Using pipes with different cross sections in each passage, for example round pipes in one passage and square pipes in another passage.

For the bypass pipes, single or double wall pipes can be used, depending on the specifications to be met for thermal efficiency when working as a bypass.

Any modifications comprised within the scope defined in the following claims can be introduced in the described embodiments of the invention.

The invention claimed is:

1. A heat exchanger (11, 41) for an EGR system comprising a casing (13, 43) housing at least one cooling chamber for the gas circulating through a plurality of pipes and heads (15, 17; 45, 47) at its ends coupled to the gas inlet pipe coming from the exhaust manifold and to the gas outlet pipe connected to the intake manifold of the engine, wherein:

a) the heat exchanger is configured with three differentiated area (21, 23, 25; 51, 53, 55) for gas circulation from the inlet pipe to the outlet pipe;

b) the inlet pipe and the outlet pipe are located at opposite ends of the exchanger (11, 41) and wherein the casing (13) has a circular section and the three differentiated gas circulation areas (21, 23, 25) are arranged concentrically inside a single cooling chamber;

the inlet head (15) includes a part (27) which, on its outer side, closes off the access of the inlet gas to the inner area (25) and the intermediate area (23), but it allows the passage thereof to the outer area (21) and, on its inner side, facilitates gas circulation from the intermediate area (23) to the inner area (25); and the outlet head (17) includes a distribution chamber (29) for distributing the gas coming from the outer area (21) to the intermediate area (23).

2. A heat exchanger (11) for an EGR system according to claim 1, wherein the gas passage pipes are distributed in a ring shape at least in the outer area (21) and in the intermediate area (23).

3. A heat exchanger (11) for an EGR system according to claim 2, characterized in that each differentiated gas circulation area (21, 23, 25; 51, 53, 55) includes a different number of gas passage pipes.

4. A heat exchanger (11) for an EGR system according to claim 2, characterized in that at least one of the differentiated gas circulation areas (21, 23, 25; 51, 53, 55) includes gas passage pipes of a circular section with a different diameter than the pipes of the other areas.

5. A heat exchanger (11) for an EGR system according to claim 2, characterized in that at least one of the differentiated gas circulation areas (21, 23, 25; 51, 53, 55) includes gas passage pipes of a different degree of heat exchange than the pipes of the other areas.

6. A heat exchanger (11) for an EGR system according to claim 2, characterized in that at least one of the differentiated gas circulation areas (21, 23, 25; 51, 53, 55) includes gas passage pipes of a different cross section than the pipes of the other areas.

7. A heat exchanger (11, 41) for an EGR system comprising a casing (13, 43) housing at least one cooling chamber for the gas circulating through a plurality of pipes and heads (15, 17; 45, 47) at its ends coupled to the gas inlet pipe coming from the exhaust manifold and to the gas outlet pipe connected to the intake manifold of the engine, characterized in that:

a) the heat exchanger is configured with three differentiated area (21, 23, 25; 51, 53, 55) for gas circulation from the inlet pipe to the outlet pipe;

b) the inlet pipe and the outlet pipe are located at opposite ends of the exchanger (11, 41) and wherein the casing (13) has a circular section and the three differentiated gas circulation areas (21, 23, 25) are arranged concentrically inside a single cooling chamber, the outer area (25) being formed by a single pipe;

the inlet head (15) includes a part (31) with a bypass valve (35) so as to on one hand, regulate the access of the inlet gas either to the outer area (21) or to the inner area (25), and on the other hand to facilitate gas circulation from the intermediate area (23) to the inner area (25);

the outlet head (17) includes a distribution chamber (29) for distributing the gas coming from the outer area (21) to the intermediate area (23); and the inner area (25) extends through the outlet head (17) to the outside of the exchanger, functioning as a gas outlet pipe.

8. A heat exchanger (11) for an EGR system according to claim 7, wherein the bypass valve (35) has a proportional actuator (37) so as to be able to distribute the inlet gas between the outer area (21) and the inner area (25).

9. A heat exchanger (11) for an EGR system according to claim 8, wherein the control means of the bypass valve (35) allow controlling said distribution by taking into account the outlet gas temperature provided by a temperature sensor.

10. A heat exchanger (11) for an EGR system according to claim 7, wherein the gas passage pipes in the outer area (21) and in the intermediate area (23) are distributed in a ring shape.

11. A heat exchanger (11, 41) for an EGR system comprising a casing (13, 43) housing at least one cooling chamber for the gas circulating through a plurality of pipes and heads (15, 17; 45, 47) at its ends coupled to the gas inlet pipe coming from the exhaust manifold and to the gas outlet pipe connected to the intake manifold of the engine, characterized in that:

a) the heat exchanger is configured with three differentiated area (21, 23, 25; 51, 53, 55) for gas circulation from the inlet pipe to the outlet pipe;

b) the inlet pipe and the outlet pipe are located at opposite ends of the exchanger (11, 41) and wherein the casing (43) has a circular section the first gas circulation area (51) occupying one of its halves and the second gas circulation area (53) and the third gas circulation area (55) occupying the other half, this latter area being located on a side close to the casing (43);

the inlet head (45) includes a part (57) configured to assume at least one position in which, on its outer side, closes off the access of the inlet gas to the second area (53) and the third area (55), but it allows the passage thereof to the first area (51) and, on its inner side, facilitates gas circulation from the second area (53) to the third area (55); and the outlet head (47) includes a distribution chamber (69) for distributing the gas coming from the first area (51) to the second area (53).

12. A heat exchanger for an EGR system according to claim 11, wherein the third gas circulation area is formed by a single pipe and extends through the outside of the heat exchanger, functioning as a gas outlet pipe.

13. A heat exchanger for an EGR system according to claim 11, wherein said part includes a bypass valve configured on one hand to regulate the access of the inlet gas either to the first area or to the third area, and on the other hand to facilitate gas circulation from the second area to the third area.

14. A heat exchanger (41) for an EGR system according to claim 13, characterized in that the bypass valve (68) has a proportional actuator (77) so as to be able to distribute the inlet gas between the first area (51) and the third area (55).

15. A heat exchanger (41) for an EGR system according to claim 14, wherein the control means of the bypass valve (68) allows control of said distribution by taking into account the outlet gas temperature provided by a temperature sensor.

16. A heat exchanger (41) for an EGR system according to claim 11, wherein it includes two cooling chambers (61, 63) at different temperatures, the first gas circulation area (51) being located inside the cooling chamber with greater cooling capacity (61) and the second gas circulation area (53) and the third gas circulation area (55) being located inside the cooling chamber with less cooling capacity (63).

17. A heat exchanger (41) for an EGR system according to claim 16, characterized in that the two cooling chambers (61, 63) are demarcated by a central plate (49) located inside the outer casing (43).

18. A heat exchanger (41) for an EGR system according to claim 16, characterized in that the two cooling chambers are structured as separate semi-casings (71, 73).

* * * * *